US010423098B2

(12) United States Patent
Sato et al.

(10) Patent No.: US 10,423,098 B2
(45) Date of Patent: Sep. 24, 2019

(54) IMAGE FORMATION APPARATUS

(71) Applicant: Oki Data Corporation, Tokyo (JP)

(72) Inventors: Naoki Sato, Tokyo (JP); Daitetsu Amada, Tokyo (JP); Satoru Tajima, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 16/105,482

(22) Filed: Aug. 20, 2018

(65) Prior Publication Data

US 2019/0086843 A1 Mar. 21, 2019

(30) Foreign Application Priority Data

Sep. 19, 2017 (JP) ..... 2017-178596

(51) Int. Cl.
*G03G 15/20* (2006.01)
*G03G 15/00* (2006.01)

(52) U.S. Cl.
CPC ..... *G03G 15/2028* (2013.01); *G03G 15/5029* (2013.01); *G03G 2215/00556* (2013.01); *G03G 2215/2045* (2013.01)

(58) Field of Classification Search
CPC ..... G03G 15/2028; G03G 2215/00556
See application file for complete search history.

(56) References Cited

U.S. PATENT DOCUMENTS 4,941,021 A * 7/1990 Uchida ..... G03G 15/2064 219/216
5,189,470 A * 2/1993 Matsuda ..... G03G 15/2064 346/136
6,564,025 B2 * 5/2003 Sameshima ..... G03G 15/2064 399/397
7,257,364 B2 * 8/2007 Ishikawa ..... G03G 15/234 399/384
7,426,353 B1 * 9/2008 Sakakibara ..... G03G 15/235 399/16
7,690,651 B2 * 4/2010 Kubochi ..... G03G 15/657 271/258.01
8,774,664 B2 * 7/2014 Koshida ..... G03G 15/657 399/400

(Continued)

FOREIGN PATENT DOCUMENTS

JP 2000-352850 A 12/2000

*Primary Examiner* — G. M. A Hyder

(74) *Attorney, Agent, or Firm* — Metrolex IP Law Group, PLLC

(57) ABSTRACT

An image formation apparatus according to one or more embodiments may include: a first conveyer; a second conveyer provided downstream of the first conveyer; a detector that detects a deflection of the medium between the first and second conveyers; a speed controller that controls a speed of the second conveyer within a first speed range; a calculator that calculates an average convey speed of the second conveyer. The calculator calculates a first average speed in a first period from when a leading end of the medium reaches the second conveyer to when the medium is conveyed a predetermined distance from the second conveyer. The speed controller changes, after the first period elapses, the speed of the second conveyer within a second speed range with the calculated first average convey speed as a criteria speed of the second conveyer, based on the detection result from the detector.

15 Claims, 9 Drawing Sheets

(56) References Cited

U.S. PATENT DOCUMENTS

| | | | | |
|---|---|---|---|---|
| 9,146,520 | B2 * | 9/2015 | Fuse | G03G 15/657 |
| 2006/0222386 | A1 * | 10/2006 | Koshida | G03G 15/657 399/44 |
| 2011/0123212 | A1 * | 5/2011 | Hasegawa | G03G 15/2028 399/68 |
| 2012/0134694 | A1 * | 5/2012 | Hara | G03G 15/657 399/45 |
| 2017/0269518 | A1 * | 9/2017 | Yamada | G03G 15/2028 |
| 2017/0269528 | A1 * | 9/2017 | Sakamaki | G03G 15/2028 |

* cited by examiner

IMAGE FORMATION APPARATUS

CROSS REFERENCE TO RELATED APPLICATIONS

This application claims priority based on 35 USC 119 from prior Japanese Patent Application No. 2017-178596 filed on Sept. 19, 2017, entitled "IMAGE FORMATION APPARATUS", the entire contents of which are incorporated herein by reference.

BACKGROUND

The disclosure relates to an image formation apparatus and particularly to an image formation apparatus in which that a deflection (a slack) of a medium is generated.

In generating a deflection (a slack) of a medium conveyed between a transfer belt and an image fixation device, an image formation apparatus according to a related art prevents the deflection of the medium from growing by measuring the time it takes from detection of the leading edge of the medium to generation of a predetermined amount of deflection of the medium, calculating the speed difference between the convey speed of the transfer belt and the convey speed of the fixation device based on the time measured, and adding the speed difference to the convey speed of the fixation device to change the convey speed of the fixation device (See, for example, Japanese Patent Application Publication No. 2000-352850).

However, in the related art that changes the convey speed of the fixation device based on the time it takes from detection of the leading edge of the medium to generation of a predetermined amount of the deflection of the medium, when the time measured fluctuates due to the detection accuracy of the sensor, the configuration of a guide member, the type of the medium, and the like, the convey speed of the medium widely fluctuates accordingly, which hinders stable conveyance of the medium and results in degradation in image quality.

An object of an embodiment of the disclosure is to achieve stable conveyance of a medium to suppress image quality degradation.

SUMMARY

An image formation apparatus according to a first aspect may include: a first conveyer that conveys the medium in a predetermined speed; a second conveyer that is disposed downstream of the first conveyer in a conveying direction of the medium, and is configured to convey the medium at a variable conveyance speed; a detector that detects a deflection of the medium between the first and second conveyers; a speed controller that controls a speed of the second conveyer within a first speed range based on a detection result from the detector; and a calculator that calculates an average convey speed of the second conveyer. The calculator calculates a first average speed in a first period from when a leading end of the medium reaches the second conveyer to when the medium is conveyed a predetermined distance from the second conveyer. The speed controller changes, after the first period elapses, the speed of the second conveyer, within a second speed range with the calculated first average convey speed as a criteria speed of the second conveyer, based on the detection result from the detector.

An image formation apparatus according to a second aspect may include: a first conveyer that conveys the medium in a predetermined speed of the medium; a second conveyer that is disposed downstream of the first conveyer in a convey direction of the medium, and is configured to convey the medium at a variable conveyance speed; a detector that detects a deflection of the medium generated between the first and the second conveyers; a speed controller that controls a speed of the second conveyer based on a detection result from the detector; and a calculator that calculates an average convey speed of the second conveyer whose convey speed is changed by the speed controller. The calculator calculates a first average convey speed of the second conveyer in a first period from when a leading end of the medium reaches the second conveyer to when the medium is conveyed a predetermined distance from the second conveyer. The speed controller executes: a first convey speed control, in the first period, that changes the convey speed of the second conveyer within a first speed range; a transition control that continues the first convey speed control until the speed of the second conveyer enters in a second speed range with respect to the first calculated average convey speed after the first period elapses, wherein the second speed control range is narrower than the first speed range; and a second convey speed control, in a second period in which the medium is conveyed the predetermined distance after the transition control, that controls the speed of the second conveyer within the second speed range with the calculated first average convey speed as a criteria speed of the second conveyer for the second period, based on the detection result from the detector.

DETAILED DESCRIPTION

Figure 1:
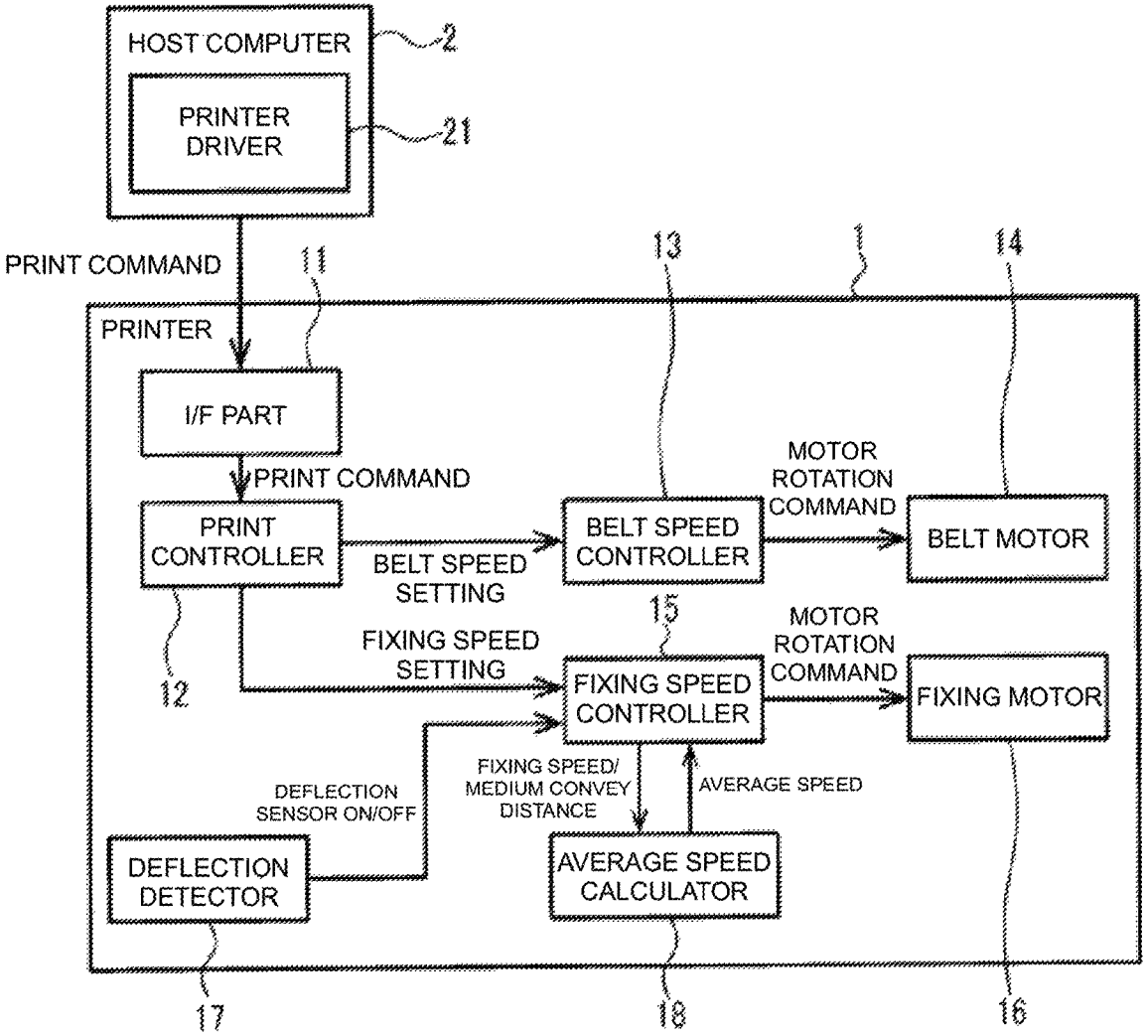
FIG. 1 is a block diagram illustrating a control configuration of a printer according to a first embodiment.

Embodiments are explained with referring to drawings. In the respective drawings referenced herein, the same constitutions are designated by the same reference numerals and duplicate explanation concerning the same constitutions is basically omitted. All of the drawings are provided to illustrate the respective examples only.

First Embodiment

Figure 2:
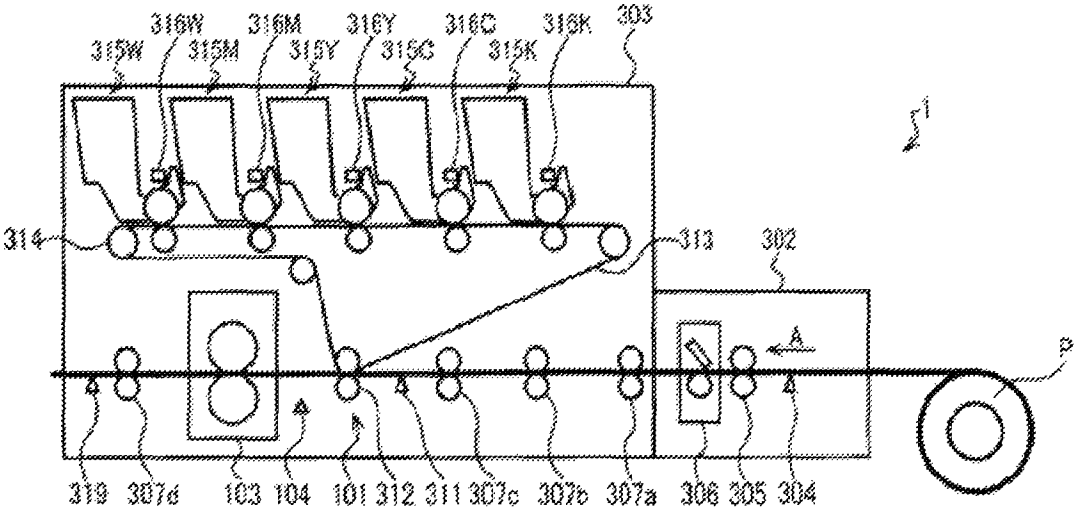
FIG. 2 is a schematic side sectional diagram illustrating a configuration of a printer according to a first embodiment.

FIG. 2 is a schematic side sectional diagram illustrating the configuration of a printer according to a first embodiment.

In FIG. 2, a printer 1 serving as an image formation apparatus performs printing by conveying a printable, long continuous medium P rolled up into a tubular shape (such as rolled paper) in a predetermined medium conveying direction indicated by the arrow A in FIG. 2, generating a slack (a deflection) of the medium P, and forming an image on the medium P. The printer 1 is for example an electrophotographic printer. Note that the configuration of the printer is not limited to the one illustrated in FIG. 2.

The printer 1 has a medium feeder section 302 that feeds a medium P to a print section 303, and the print section 303 that forms an image on the medium P fed from the medium feeder section 302. The medium feeder section 302 has a cutter IN sensor 304, feed rollers 305 as a conveyance device, and a cutter unit 306 as a cutter device.

The cutter IN sensor 304 is disposed upstream of the feed rollers 305 and the cutter unit 306 in the medium conveying direction, and detects a medium P fed to the cutter unit 306. The feed rollers 305 are a pair of rollers disposed downstream of the cutter IN sensor 304 in the medium conveying direction and clamp and convey a medium P by rotating. The feed rollers 305 constitute, together with other pairs of feed rollers 307*a* to 307*d*, a conveyer as a conveyance device that conveys a medium P in the medium conveying direction indicated by the arrow A in FIG. 2.

The cutter unit 306 is disposed downstream of the feed rollers 305 in the medium conveying direction and cuts a medium P conveyed by the conveyer to a predetermined length. The cutter unit 306 includes a cutter, such as a rotary cutter, for example. The cutter unit 306 is designed to cut, by rotating, a conveyed medium P in a direction substantially orthogonal to the medium conveying direction. The cutter unit 306 cuts a medium P to a predetermined length in the medium conveying direction based on the timing of detection by the cutter IN sensor 304.

The print section 303 or a printer section has the feed rollers 307*a* to 307*d*, a write sensor 311, a secondary transfer roller 312, a transfer belt 313, belt rollers 314, a backup roller 317, image drum (ID) units 315K, 315C, 315Y, 315M, 315W, light emitting diode (LED) heads 316K, 316C, 316Y, 316M, 316W, deflection sensor 104, a fixation device 103, and a discharge sensor 319.

The secondary transfer roller 312, the transfer belt 313, the belt rollers 314, and the backup roller 317 constitute a transfer belt unit 101.

The feed rollers 307*a* are a pair of rollers disposed downstream of the cutter unit 306 in the medium conveying direction and clamp and convey a medium P by rotating. The feed rollers 307*b* are a pair of rollers disposed downstream of the feed rollers 307*a* in the medium conveying direction and clamp and convey a medium P by rotating. The feed rollers 307*c* are a pair of rollers disposed downstream of the feed rollers 307*b* in the medium conveying direction and clamp and convey a medium P by rotating.

The write sensor 311 is a medium detector disposed downstream of the feed rollers 307*c* in the medium conveying direction. The write sensor 311 is used to detect a medium P and adjust the position at which the secondary transfer roller 312 writes a toner image onto the detected medium P.

The secondary transfer roller 312 is disposed downstream of the write sensor 311 in the medium conveying direction while facing the backup roller 317 with the transfer belt 313 interposed therebetween. The secondary transfer roller 312 clamps and conveys a medium P with the transfer belt 313 and transfers a toner image formed on the transfer belt 313 to the medium P. In other words, the medium P is interposed by the secondary transfer roller 312 and the backup roller 317 and is transferred by rotation of the secondary transfer roller 312 and the backup roller 317. The secondary transfer roller 312 transfers a toner image formed on the transfer belt 313 to a medium P by applying high voltage.

The transfer belt 313 is rotatably looped around rollers such as the belt rollers 314 and the backup roller 317, receives toner images formed by the ID units 315K, 315C, 315Y, 315M, 315W, and conveys the toner images to the secondary transfer roller 312.

The belt rollers 314 allow the transfer belt 313 to be rotatably looped therearound, and rotate the transfer belt 313 by being driven and rotated by a belt motor. The belt unit 101, which includes the secondary transfer roller 312, the transfer belt 313, the belt rollers 314, and the backup roller 317, transfers toner images (images of developer) onto a medium P and also conveys the medium P to the fixation device 103 by the rotation of the transfer belt 313.

The ID units 315K, 315C, 315Y, 315M, 315W each have a rotatably-disposed photosensitive drum (an image carrier) and perform image formation operation. Specifically, the ID units 315K, 315C, 315Y, 315M, 315W form black (K), cyan (C), yellow (Y), magenta (M), and white (W) toner images on the respective photosensitive drums, respectively, and transfer the toner images to the oppositely-disposed transfer belt 313 (this transfer is called primary transfer).

The LED heads 316K, 316C, 316Y, 316M, 316W selectively exposure the surfaces of the photosensitive drums of the corresponding ID units 315K, 315C, 315Y, 315M, 315W, and form electrostatic latent images thereon. Toner images are formed when toner is supplied to the electrostatic latent images formed on the photosensitive drums.

The ID units 315K, 315C, 315Y, 315M, 315W, the LED heads 316K, 316C, 316Y, 316M, 316W, and the secondary transfer roller 312 and the transfer belt 313 of the belt unit 101 perform image formation to form toner images on a medium P.

The deflection sensor 104 or a slack sensor is disposed downstream of the secondary transfer roller 312 of the belt unit 101 and upstream of the fixation device 103 in the medium conveying direction. The deflection sensor detects a deflection or a slack, generated between the belt unit 101 and the fixation device 103, of the medium P that is being conveyed by the belt unit 101 and the fixation device 103.

The fixation device 103, serving as a second conveyer, is disposed downstream of the deflection sensor 104 in the medium conveying direction. The fixation device 103 fuses toner images transferred on a medium P while conveying the medium P and thus fixes the tone images onto the medium P. Specifically, the fixation device 103 includes fixing rollers at least one of which has a heating member therein and fixes toner images transferred on the medium P using heat and pressure. Details are given later as to deflection of the medium P between the belt unit 101 and the fixation device 103 and the deflection sensor 104 for detecting the deflection.

The feed rollers 307*d* are a pair of rollers disposed downstream of the fixation device 103 in the medium conveying direction and clamp and discharge a medium P to the outside of the printer 1 by rotating. The discharge sensor 319 is disposed downstream of the feed rollers 307*d* in the medium conveying direction and detects the leading edge and tailing edge of, and the presence and absence of, a medium P conveyed by the feed rollers 307*d*.

Although the cutter unit 306 is disposed upstream of the secondary transfer roller 312 in the medium conveying direction in the present example described herein, the present disclosure is not limited to this case. The cutter unit 306 may be disposed downstream of the secondary transfer roller 312 in the medium conveying direction.

The printer 1 thus constituted receives a print command from a host computer 2 illustrated in FIG. 1 and conveys and prints a continuous medium P based on the print command.

Figure 3A:
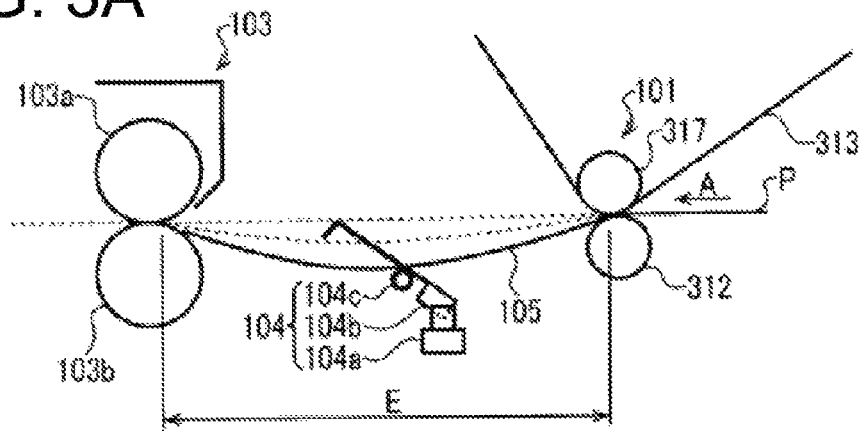
FIGS. 3A to 3C are diagrams illustrating a configuration of a deflection generation area according to a first embodiment.
Figure 3B:
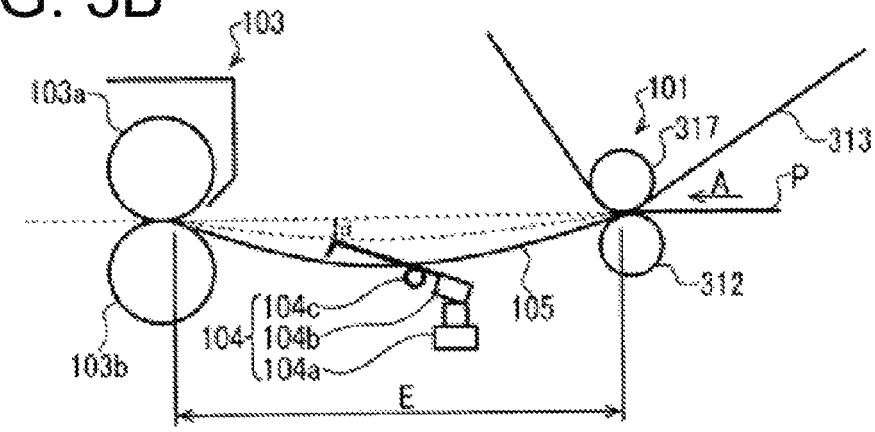
Figure 3C:
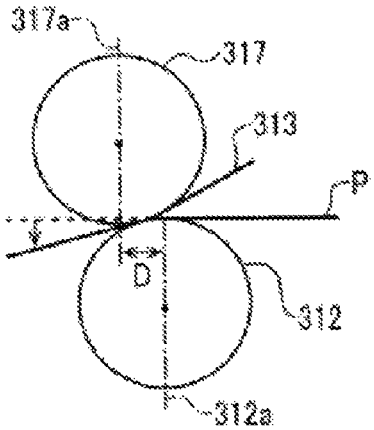

FIGS. 3A to 3C are diagrams illustrating the configuration of the deflection generation area according to a first embodiment. FIGS. 3A and 3B are diagrams illustrating the entire deflection generation area, and FIG. 3C is a diagram magnifying a contact between the secondary transfer roller and the backup roller.

In FIGS. 3A and 3B, the area E, where a deflection is formed, exists between the belt unit 101 and the fixation device 103.

The belt unit 101, serving as a first conveyer, conveys a medium P at a predetermined convey speed, and has the transfer belt 313 rotatably looped around the backup roller 317; a belt motor that rotates the rollers; and the secondary transfer roller 312 that comes into contact with the outer circumferential surface of the rotating transfer belt 313 and conveys a medium P in the medium conveying direction indicated by the arrow A illustrated in FIGS. 3A and 3B by clamping the medium P with the transfer belt 313.

With the secondary transfer roller 312 and the transfer belt 313 which is rotated by the belt motor, the belt unit 101 conveys a medium P to the deflection area E and the fixation device 103 located downstream in the medium conveying direction.

The secondary transfer roller 312 is, as illustrated in FIG. 3C, disposed upstream of the backup roller 317 in the medium conveying direction. For example, the secondary transfer roller 312 is disposed upstream of the backup roller 317 so that a vertical line 312*a* running through the rotary axis of the secondary transfer roller 312 is offset by a predetermined distance D (e.g., approximately 2 mm) in the medium conveying direction from a vertical line 317*a* running through the rotary axis of the backup roller 317.

When the secondary transfer roller 312 and the backup roller 317 are thus disposed, the vector of a tangent line of the transfer belt 313 and the secondary transfer roller 312 is, as indicated by the arrow in FIG. 3C, directed downward toward a medium guide 105 to be described later, causing the medium P to be conveyed along the medium guide 105 and facilitating generation of a downward deflection of the medium P toward direction of gravity. Thus, advantageously, the deflection sensor 104 to be described later can stably detect the deflection of the medium P.

Note that the belt unit 101 is not limited to the configuration having the transfer belt 313, and may be provided with, for example, a pair of rotatable conveyance rollers, as long as the belt unit 101 is disposed upstream of the deflection area E and the fixation device 103 in the medium conveying direction and is able to convey a medium P to the deflection area E and the fixation device 103 at a convey speed different from the medium convey speed of the fixation device 103.

The fixation device 103 as a second conveyer conveys a medium at a variable convey speed so that the second conveyer is configured to change a convey speed of a medium. The fixation device 103 is disposed downstream of the belt unit 101 and the deflection area E in the medium conveying direction, and clamps and conveys a medium P by rotation of a fixing roller 103*a* and a fixing roller 103*b* which are a pair of rollers internally provided.

It is generally known that the medium convey speed of the fixation device 103 varies widely. Possible factors for this include individual differences and aging deterioration of the fixing rollers 103*a*, 103*b* and difference in the type of a medium (the coefficient of friction and the thickness). Note that the fixation device 103 is not limited to the configuration having the pair of rollers, and may be provided with, for example, a rotatable belt or roller, as long as it is able to convey a medium at a convey speed different from the medium convey speed of the belt unit 101.

The deflection area E is a space (area) prepared downstream of the belt unit 101 and upstream of the fixation device 103 in the medium conveying direction, and is an area where the deflection is generated in a medium P by the speed difference between the medium convey speed of the belt unit 101 (hereinafter referred to as a "belt speed") and the medium convey speed of the fixation device 103 (hereinafter referred to as a "fixing speed").

The reason for generating the deflection of the medium P between the belt unit 101 and the fixation device 103 is to prevent toner images transferred on the medium P by the belt unit 101 from being disturbed (in the form of, e.g., a "shock line", which is a white line formed in a toner image) by application of excessive tension to the medium P.

Disposed in the deflection area E are the medium guide 105 that guides a medium P and the deflection sensor 104 that detects deflection generated in the medium P. As explained above, the deflection sensor 104 enables to detect deflection of the medium P stably by disposing the deflection sensor 104 lower than a conveyance path defined by the medium guide 105 between the first and second conveyers 101 and 103.

The medium guide 105 guides the medium P between the belt unit 101 and the fixation device 103. The medium guide 105 is curved to bulge downward and is disposed in, for example, a lower part of the deflection area E connecting the belt unit 101 and the fixation device 103 together.

The medium guide 105 guides a medium P so that the leading edge of the medium P may reach an area between the fixing roller 103*a* and the fixing roller 103*b* of the fixation device 103.

Further, the medium guide 105 guides the lower surface of the medium P in which deflection is generated between the belt unit 101 and the fixation device 103.

The medium guide 105 is thus disposed to form a space below an imaginary straight line connecting the belt unit 101 and the fixation device 103 together, i.e., below the medium P stretched between the belt unit 101 and the fixation device 103. Thus, deflection is generated in the medium P between the belt unit 101 and the fixation device 103.

Although deflection of the medium P is generated below the imaginary straight line connecting the belt unit 101 and the fixation device 103 together in a first embodiment, the deflection of the medium P may be generated above the straight line. The deflection sensor 104 as a detector is disposed between the belt unit 101 and the fixation device 103 and detects whether a medium P is deflected or stretched between the belt unit 101 and the fixation device 103. The deflection sensor 104 is disposed in a lower space of the deflection area E between the belt unit 101 and the fixation device 103, and detects the position of the lowermost point of deflection generated in the medium P.

The deflection sensor 104 is, for example, an optical-transmission-type sensor is provided with an optical-transmission-type photointerrupter 104*a*, a lever 104*b*, and a rotary shaft 104*c*.

The lever 104*b* is disposed to be able to rotate about the rotary shaft 104*c* provided to the medium guide 105. A contact portion to come into contact with a medium P is formed at one end of the lever 104*b*, and a shield plate is attached to the other end of the lever 104*b*. The contact portion of the lever 104*b* protrudes from a hole formed in the medium guide 105 and comes into contact with a medium P, and the shield plate is designed to shield or not shield light emitted by a light emitting device of the optical-transmission-type photointerrupter 104*a* depending on the turning of the lever 104*b*.

The optical-transmission-type photointerrupter 104*a* detects that the medium P is stretched (referred to as a stretched state) when detecting that the optical axis is being shielded by the shield plate of the lever 104*b*, and detects that deflection is generated in the medium P (referred to as deflected condition) when detecting that the optical axis is not being shielded.

For example, when the lever 104*b* is situated as illustrated in FIG. 3A, the optical-transmission-type photointerrupter 104*a* detects that the medium P is in the stretched state, and when the lever 104*b* is situated as illustrated in FIG. 3B, the optical-transmission-type photointerrupter 104*a* detects that the medium P is in the deflected condition where deflection d (of, e.g., approximately 4.5 mm) is generated in the stretched medium P.

The deflection sensor 104 thus constituted outputs an ON signal indicating that the medium P is stretched upon detecting that the medium P is stretched, and outputs an OFF signal indicating that the medium P is deflected upon detecting that the medium P is in deflected condition. Although the deflection sensor 104 is provided with an optical-transmission-type sensor in a first embodiment, the deflection sensor 104 may be provided with an optical-reflection-type sensor that detects stretched condition and deflected condition of the medium P.

FIG. 1 is a block diagram illustrating the control configuration of the printer according to a first embodiment.

In FIG. 1, the printer 1 has an 11, a print controller 12, a belt speed controller 13, a belt motor 14, a fixing speed controller 15, a fixing motor 16, deflection detector 17, and an average speed calculator 18.

The I/F part 11 allows transmission and reception of information between the printer 1 and the host computer 2, which is a higher-level device, and receives, for example, print data generated in a printer driver 21 in the host computer 2 as a print command. The I/F part 11 notifies the print controller 12 of a print command received.

The print controller 12 acquires a print command received from the host computer 2 through the I/F part 11, and controls the controllers based on the print command to form and print an image on a medium. The print controller 12 notifies the belt speed controller 13 of belt speed setting information to set the convey speed of the belt, and notifies the fixing speed controller 15 of fixing speed setting information to set a criteria fixing speed.

Based on the belt speed setting information notified of by the print controller 12, the belt speed controller 13 outputs a motor rotation command to the belt motor 14 to control the rotation of the belt motor 14, thereby controlling the belt convey speed of the belt unit. The belt motor 14 rotates based on a motor rotation command outputted from the belt speed controller 13, thereby rotating the transfer belt 313 of the belt unit 101 illustrated in FIGS. 3A, 3B, and 3C and conveying a medium.

The fixing speed controller 15 as a speed controller controls the fixing speed, which is the convey speed of the fixation device 103 illustrated in FIGS. 3A, 3B, and 3C, in a predetermined speed range (a first speed range) based on a result of detection by the deflection sensor 104 from the deflection detector 17.

Based on the fixing speed setting (criteria fixing speed as a basis) information notified of by the print controller 12, the fixing speed controller 15 outputs a motor rotation command to the fixing motor 16 to start rotating the fixing motor 16, and then controls, i.e., changes (increases or decreases) the rotation speed of the fixing motor 16 based on ON/OFF information on the deflection sensor 104 from the deflection detector 17 to control the rotation speed of the fixing rollers of the fixation device 103.

Also, the fixing speed controller 15 notifies the average speed calculator 18 of fixing speed information and medium conveying distance information at a predetermined interval of time (time period) for controlling the rotation speed of the fixing motor 16 (hereinafter referred to as a control interval).

The fixing speed information is information on the rotation speed of the fixing motor 16 instructed by a motor rotation command outputted to the fixing motor 16 and indicates a fixing speed. The medium conveying distance information is information on the distance of a medium P conveyed, which is calculated based on the rotation amount of the fixing motor 16.

Further, based on a command (namely an average speed application command) from the average speed calculator 18, the fixing speed controller 15 controls the rotation of the fixing motor 16 by outputting a motor rotation command to the fixing motor 16 based on the average speed of the fixing motor 16 calculated by the average speed calculator 18, and thereby changes the criteria fixing speed, which is the rotation speed of the fixing rollers of the fixation device 103.

The fixing motor 16 rotates based on a motor rotation command outputted from the fixing speed controller 15 and thereby rotates the fixing rollers (103*a*, 103*b*) of the fixation device 103 illustrated in FIGS. 3A, 3B, and 3C to convey a medium. The deflection detector 17 notifies the fixing speed controller 15 of ON/OFF information which is information on an output signal from the deflection sensor 104 illustrated in FIGS. 3A, 3B, and 3C.

The deflection detector 17 detects (monitors), using the deflection sensor 104, deflection of a medium conveyed from the transfer belt unit 101 illustrated in FIGS. 3A, 3B, and 3C to the fixation device 103 through the deflection area E, and notifies the fixing speed controller 15 of ON/OFF information indicative of the detected state.

The fixing speed controller 15 makes a speed adjustment by generating a new motor rotation command by adding speed change information based on the ON/OFF information notified of and outputting the new motor rotation command to the fixing motor 16 to change the speed of the fixing motor 16. The average speed calculator 18 as a calculator calculates the average convey speed of the fixation device changed by the fixing speed controller 15, i.e., calculates an average fixing speed.

The average speed calculator 18 calculates an average fixing speed within a predetermined conveying distance of a medium P based on fixing speed information and medium conveying distance information notified of by the fixing speed controller 15, generates an average speed application command, and notifies the fixing speed controller 15 of the average speed application command. The average speed application command is a command that instructs the fixing speed controller 15 to apply the average fixing speed calculated by the average speed calculator 18 to a motor rotation command to the fixing motor 16.

The fixing speed controller 15, upon being notified of an average speed application command by the average speed calculator 18, changes the criteria fixing speed regarding the rotation speed of the fixing rollers of the fixation device based on the average speed application command, and if coarse speed control is being performed, switches information on change in the speed of the fixing motor from a speed change value for coarse speed control to a speed change value for fine speed control.

The printer 1 thus constituted includes a controller such as a central processing unit (CPU) and a storage part such as memory, and the controller controls the overall operation of the printer 1 based on a control program (software) stored in the storage part. For example, the print controller 12, the belt speed controller 13, the fixing speed controller 15, and the average speed calculator 18 can be implemented using: a memory as a storage device that stores a control program; and a processor that executes the control program stored in the memory. Otherwise, parts of the print controller 12, the belt speed controller 13, the fixing speed controller 15, and the average speed calculator 18 may be implemented using a circuit, and the rests of the print controller 12, the belt speed controller 13, the fixing speed controller 15, and the average speed calculator 18 may be implemented using: a memory as a storage device that stores a control program; and a processor that executes the control program stored in the memory. Further, the printer 1 performs fixing speed control in which the fixing speed controller 15 adjusts the speed of the fixing motor 16 so that the amount of deflection of the medium P generated in the deflection area E illustrated in FIGS. 3A, 3B, and 3C may stay within a predetermined range.

In the printer 1 of a first embodiment, the average speed calculator 18 calculates an average fixing speed in a coarse speed control period from when the leading edge of a medium P reaches the fixation device 103 illustrated in FIGS. 3A, 3B, and 3C to when the medium P is conveyed a predetermined distance. Then, in a fine speed control period following the coarse speed control period, the fixing speed controller 15 sets the average fixing speed calculated by the average speed calculator 18 as a criteria convey speed of the fixation device 103 illustrated in FIGS. 3A, 3B, and 3C (fixing speed) for the fine speed control period and change the fixing speed within a predetermined speed range (a second speed range) based on a result of detection by the deflection sensor of the deflection detector 17.

Figure 4:
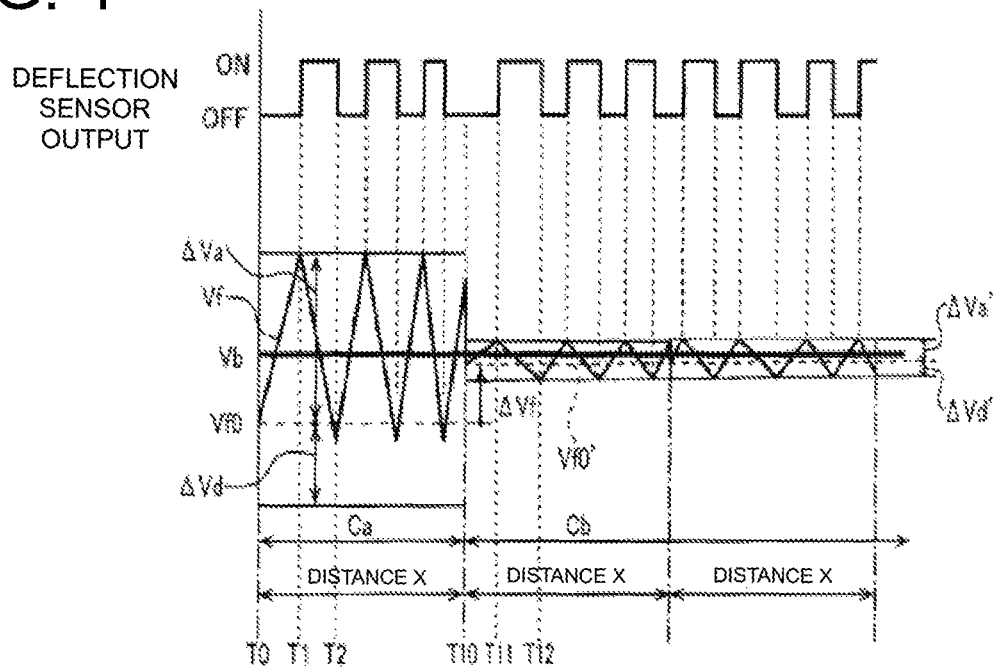
FIG. 4 is a timing chart illustrating fixing speed control according to a first embodiment.

FIG. 4 is a timing chart illustrating fixing speed control according to a first embodiment.

With reference to FIG. 4 and also to FIGS. 1 and 3A to 3C, a description is given of fixing speed control performed by the printer, following the timings denoted by T. The print controller 12 of the printer 1 causes the belt speed controller 13 to control the rotation of the belt motor 14 to control the belt speed and causes the fixing speed controller 15 to control the fixing motor 16 to control the fixing speed.

T0: Once the leading edge portion of a medium P reaches the fixing rollers 103*a,* 103*b,* the fixing speed controller 15 starts fixing speed control. It is assumed here that the deflection sensor 104 outputs an OFF signal indicating that deflection is generated in the medium P.

Further, the belt speed is controlled and set to a predetermined belt speed Vb by the belt speed controller 13, and a fixing speed Vf is controlled and set to an initial fixing speed Vf0 (initial criteria fixing speed) by the fixing speed controller 15. The relation between the belt speed Vb and the initial fixing speed Vf0 is such that the belt speed Vb>the initial fixing speed Vf0 so that deflection may be generated in the medium P.

Note that the initial fixing speed Vf0 is usually set to be lower than the belt speed Vb by approximately 2%, but widely fluctuates due to the individual difference of the fixation device 103 or the type of a medium used. Thus, the initial fixing speed Vf0 tends to be lower than the belt speed Vb by 2% or more.

Upon receiving OFF information on the deflection sensor 104 from the deflection detector 17, the fixing speed controller 15 controls the fixing speed Vf to make deflection of the medium P smaller. When the fixing speed Vf thus increased exceeds the belt speed Vb, deflection of the medium P is gradually decreased.

T1: When the deflection of the medium P is less to the point where the medium P is stretched, the deflection sensor 104 outputs an ON signal indicating that the medium P is stretched. Upon receiving ON information on the deflection sensor 104 from the deflection detector 17, the fixing speed controller 15 decreases the fixing speed Vf to make deflected condition to the medium P. When the fixing speed Vf thus decreased falls below the belt speed Vb, deflection of the medium P gradually grows.

T2: When deflection of the medium P grows more and more to the point where the medium P has a predetermined amount of deflection, the deflection sensor 104 outputs an OFF signal indicating that the medium P is deflected. Upon receiving OFF information on the deflection sensor 104 from the deflection detector 17, the fixing speed controller 15 increases the fixing speed Vf to make deflection of the medium P smaller. When the fixing speed Vf thus increased falls below the belt speed Vb, the deflection of medium P is gradually decreased.

The fixing speed controller 15 repeats the fixing speed control of T1 and T2 to control the amount of deflection generated in the medium P. In this embodiment, the period in which to repeat the control of T1 and T2 three times or so is referred to as a coarse speed control period Ca, in which the average of the fixing speed Vf is calculated.

The coarse speed control period Ca is a predetermined period to repeat the control of for example T1 and T2 for example two to three times, and is a period from when the leading edge of a medium P reaches the fixation device 103 to when the medium P is conveyed a predetermined distance X. An upper-limit addition value ΔVa of the fixing speed Vf is set to satisfy "(the initial fixing speed Vf0+the upper-limit addition value ΔVa)>the belt speed Vb", and an upper-limit subtraction value ΔVd of the fixing speed Vf is set to satisfy "(the fixing speed Vf0−the upper-limit subtraction value ΔVd)<the belt speed Vb".

These values are thus set so that the fixing speed Vf may be increased to exceed the belt speed Vb or decreased to fall below the belt speed Vb.

This way, in a first embodiment, in the coarse speed control period Ca as a first period, the fixing speed is changed within the first speed range the upper-limit fixing speed of which is (the initial fixing speed Vf0+the upper-limit addition value ΔVa) and the lower-limit fixing speed of which is (the initial fixing speed Vf0−the upper-limit subtraction value ΔVd). After the coarse speed control period Ca, the average speed calculator 18 calculates the average of the fixing speed Vf in the coarse speed control period Ca as an average fixing speed (an average fixing speed in the first period Ca or a first average fixing speed), and notifies the fixing speed controller 15 of an average speed application command containing information on the average fixing speed.

The fixing speed controller 15 calculates the difference ΔVf between the initial fixing speed Vf0 and the average fixing speed contained in the average speed application command.

T10: After the coarse speed control period Ca, the fixing speed controller 15 next enters a fine speed control period Cb, and obtains a criteria fixing speed Vf0' for the fine speed control period Cb, by adding the difference ΔVf to the initial criteria fixing speed Vf0. In other words, the criteria fixing speed (for the fine speed control period Cb) Vf0'=Vf0+ΔVf.

Note that the fine speed control period Cb is a period in which the medium P is conveyed the predetermined distance X and is repeated every time the medium P is conveyed the predetermined distance X. The fixing speed controller 15 updates the upper-limit value and the lower-limit value of the fixing speed Vf for the fine speed control period Cb by making the upper-limit addition value ΔVa' for the fixing speed Vf in the fine speed control period Cb smaller than the upper-limit addition value ΔVa in the coarse speed control period Ca, and making the upper-limit subtraction value ΔVd' in the fine speed control period Cb smaller than the upper-limit subtraction value ΔVd in the coarse speed control period Ca.

The upper-limit addition value ΔVa' and the upper-limit subtraction value ΔVd' are determined by the difference between the belt speed Vb and the fixing speed Vf0', and the minimum values of the upper-limit addition value ΔVa' and the upper-limit subtraction value ΔVd' may be the minimum value of the absolute value of (the belt speed Vb−the fixing speed Vf0'). In other words, the smaller the difference between the belt speed Vb and the fixing speed Vf0', the smaller the upper-limit addition value ΔVa' and the upper-limit subtraction value ΔVd' can be.

However, when the upper-limit addition value ΔVa'<(the belt speed Vb−the fixing speed Vf0'), the deflection of the medium P stays increased. Thus, considering variations in the belt speed and the fixing speed, a predetermined adjustment value is added to the upper-limit addition value ΔVa'. The same adjustment is made to the upper-limit subtraction value ΔVd', as well.

Next, upon receiving OFF information on the deflection sensor 104 from the deflection detector 17, the fixing speed controller 15 increases the fixing speed Vf from the fixing speed Vf0' to make deflection of the medium P smaller.

When the fixing speed Vf thus increased falls below the belt speed Vb, deflection of the medium P is smaller.

T11: When deflection of medium P gradually declines to the point where the medium P is stretched, the deflection sensor 104 outputs an ON signal indicating that the medium P is stretched.

Upon receiving ON information on the deflection sensor 104 from the deflection detector 17, the fixing speed controller 15 decreases the fixing speed Vf to deflect the medium P. When the fixing speed Vf thus decreased falls below the belt speed Vb, the deflection of the medium P gradually grows.

T12: When deflection of the medium P gradually grows to the point where a predetermined amount of deflection is generated in the medium P, the deflection sensor 104 outputs an OFF signal indicating that the medium P is in deflected condition.

Upon receiving OFF information on the deflection sensor 104 from the deflection detector 17, the fixing speed controller 15 increases the fixing speed Vf to make deflection of the medium P smaller. When the fixing speed Vf thus increased exceeds the belt speed Vb, the deflection of the medium P is smaller. Thereafter, the fixing speed controller 15 repeats the fixing speed control of T11 and T12 to control the amount of deflection generated in the medium P.

This way, in a first embodiment, in the fine speed control period Cb as a second period, the fixing speed is changed within the second speed range the upper-limit fixing speed of which is (the fixing speed Vf0'+the upper-limit addition value αVa') and the lower-limit fixing speed of which is (the fixing speed Vf0'−the upper-limit subtraction value ΔVd'). The second speed range is narrower than the first speed range.

Figure 5:
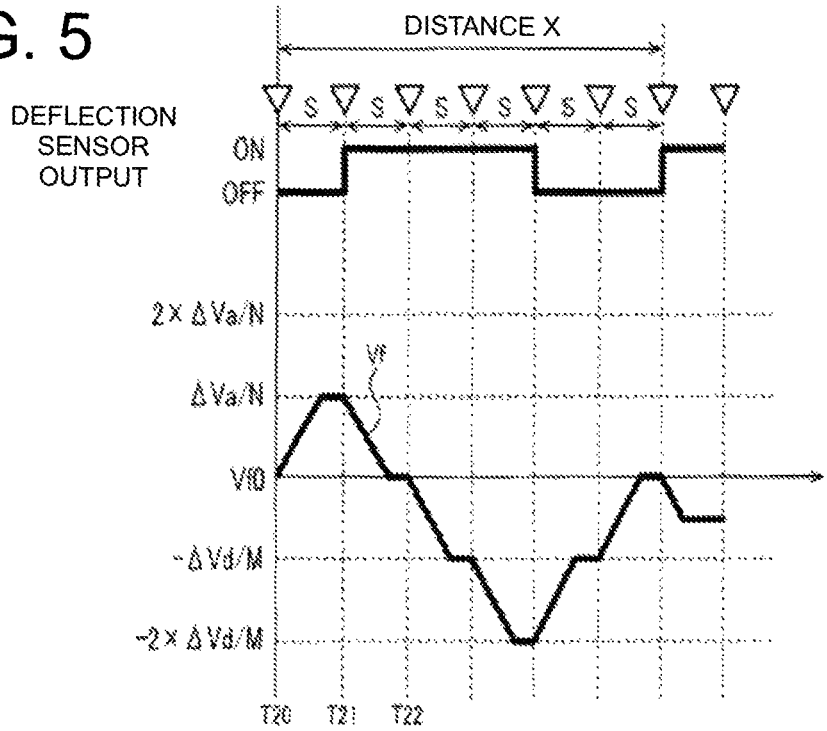
FIG. 5 is a diagram illustrating average fixing speed calculation control according to a first embodiment.

FIG. 5 is a diagram illustrating average fixing speed calculation control according to a first embodiment.

With reference to FIG. 5 and also to FIGS. 1, 3A, 3B, and 3C, a description is given of the average fixing speed calculation control performed by the printer.

In the coarse speed control period Ca and the fine speed control period Cb illustrated in FIG. 4, the average speed calculator 18 of the printer 1 calculates an average fixing speed based on fixing speed information and medium conveying distance information notified of by the fixing speed controller 15.

The fixing speed controller 15 monitors an output signal from the deflection sensor 104 at a predetermined control interval S (e.g., approximately 10 ms). Based on the output signal from the deflection sensor 104, the fixing speed controller 15 controls the fixing speed Vf (or the fixing speed Vf') at the predetermined control interval S.

In a first embodiment, an amount by which to change the fixing speed at the predetermined control interval S is determined in advance, and the amount of increase is set to the upper-limit addition value ΔVa/N and the amount of decrease is set to the upper-limit subtraction value ΔVd/M.

Note that these upper-limit addition value ΔVa and upper-limit subtraction value ΔVd are the upper-limit addition value ΔVa and the upper-limit subtraction value ΔVd illustrated in FIG. 4, N is the partition number for the upper-limit addition value ΔVa, and M is the partition number for the upper-limit subtraction value ΔVd. The slope of change in speed by speed change is gentle when the partition number N and the partition number M are large and is steep when the partition number N and the partition number M are small.

In a first embodiment, the partition number N and the partition number M for the fine speed control period Cb illustrated in FIG. 4 are set to be larger than those for the coarse speed control period Ca. Thus, the slope of change in fixing speed by speed increase or decrease is gentler in the fine speed control period Cb than in the coarse speed control period Ca.

As described, in the coarse speed control period Ca, the fixing speed controller 15 continues to perform the coarse speed control as first convey speed control to increase or decrease the fixing speed Vf by a first speed amount, and in the fine speed control period Cb, the fixing speed controller 15 performs the fine speed control as second convey speed control to change the fixing speed Vf' by a second speed amount which is smaller than the first speed amount.

Upon receiving OFF information on the deflection sensor 104 from the deflection detector 17, the fixing speed controller 15 increases the fixing speed Vf to make deflection of the medium P smaller. For example, upon receiving OFF information on the deflection sensor 104 at T20, the fixing speed controller 15 increases the fixing speed Vf by adding the upper-limit addition value ΔVa/N as an amount of addition to the initial criteria fixing speed Vf0.

On the other hand, upon receiving ON information on the deflection sensor 104 from the deflection detector 17, the fixing speed controller 15 decreases the fixing speed Vf to make deflected condition to the medium P.

For example, upon receiving ON information on the deflection sensor 104 at T21, the fixing speed controller 15 decreases the fixing speed Vf by subtracting the upper-limit subtraction value ΔVd/M as an amount of subtraction from the fixing speed Vf. Receiving ON information on the deflection sensor 104 at T22 as well, the fixing speed controller 15 again decreases the fixing speed Vf by subtracting the upper-limit subtraction value ΔVd/M as an amount of subtraction from the fixing speed Vf.

Although the upper-limit addition value ΔVa/N and the upper-limit subtraction value ΔVd/M are illustrated as being equal in FIG. 5, the upper-limit addition value ΔVa/N and the upper-limit subtraction value ΔVd/M may be different from each other.

At the control interval S, the fixing speed controller 15 controls the fixing speed Vf, and notifies the average speed calculator 18 of fixing speed information and medium conveying distance information calculated from the amount of rotation of the fixing motor 16.

Thus notified of the fixing speed information and the medium conveying distance information, the average speed calculator 18 cumulatively adds the fixing speed Vf indicated by the fixing speed information to the storage device, and once the medium is conveyed the predetermined distance X, i.e., after the coarse speed control period Ca or the fine speed control period Cb illustrated in FIG. 4, divides the cumulative value of the fixing speed Vf by the number of control intervals S to calculate an average fixing speed.

After calculating the average fixing speed in the coarse speed control period Ca (the first average fixing speed) or the average fixing speed in the fine speed control period Cb (the second average fixing speed), the average speed calculator 18 notifies the fixing speed controller 15 of an average speed application command containing the average fixing speed thus calculated.

The fixing speed controller 15 sequentially applies the average fixing speed contained in the average speed application command thus notified of to the fixing speed Vf0' as a criteria fixing speed for the next fine speed control period Cb illustrated in FIG. 4.

The operation of the above-described configuration is described.

Figure 6:
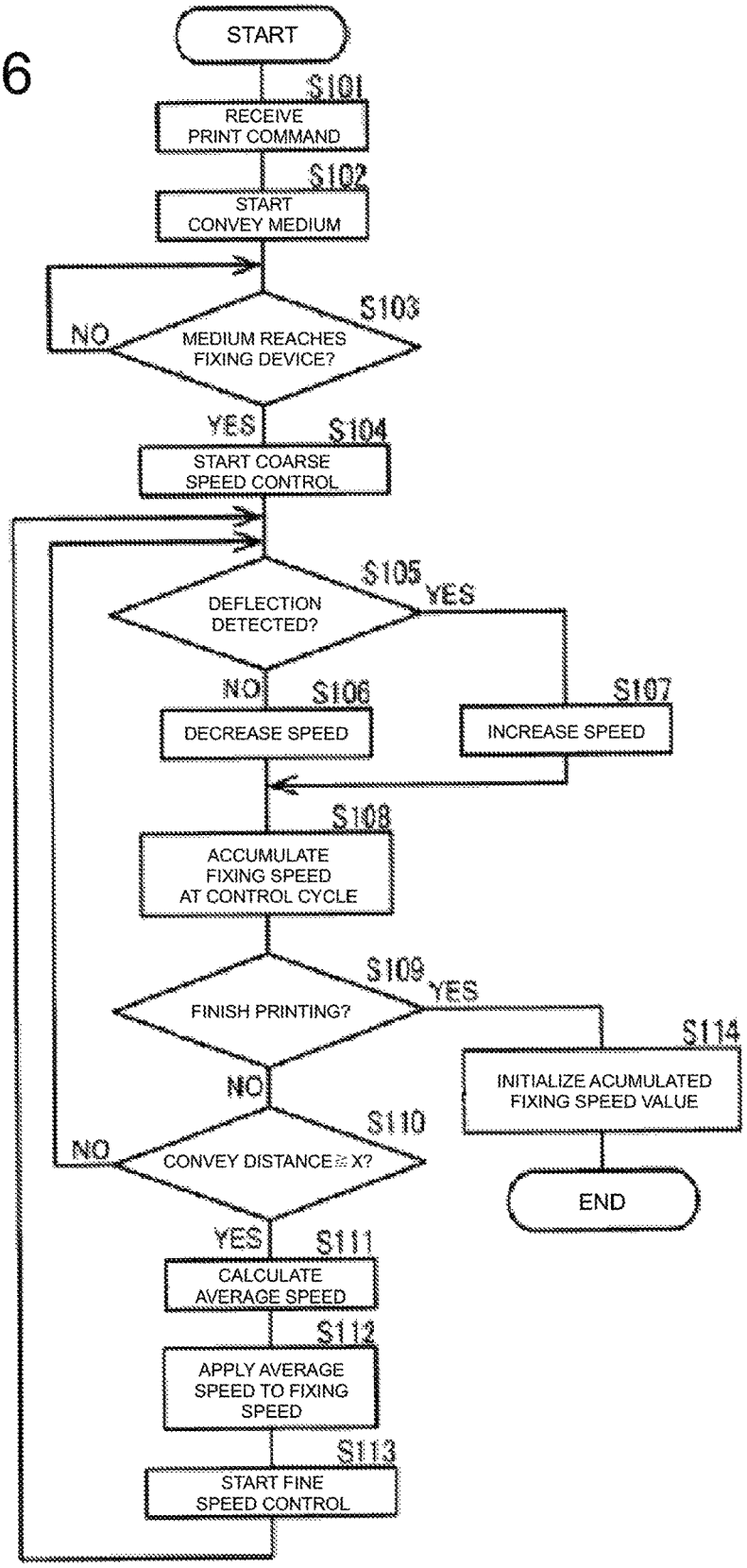
FIG. 6 is a flowchart illustrating fixing speed control processing according to a first embodiment.

FIG. 6 illustrates a flowchart of fixing speed control processing performed by the printer. Following the steps denoted by S in the flowchart in FIG. 6, fixing speed control processing according to a first embodiment is described with additional reference to FIGS. 1, 3A to 3C, 4, and 5.

S101: The I/F part 11 of the printer 1 receives a print command sent from the printer driver 21 of the host computer 2 and notifies the print controller 12 of the print command.

S102: Based on the print command notified of by the I/F part 11, the print controller 12 makes a belt speed setting for the belt speed controller 13 and makes a fixing speed setting for the fixing speed controller 15 to start conveyance of a medium P. The belt speed controller 13 outputs a motor rotation command based on the belt speed setting to rotate the belt motor 14, and the fixing speed controller 15 outputs a motor rotation command based on the fixing speed setting to rotate the fixing motor 16, thereby conveying the medium P. Note that a cumulative fixing speed value, a cumulative medium conveying distance value, and a control count that are stored in the storage device are initialized to "0".

S103: Based on the amount of rotation of the belt motor 14, the print controller 12 determines whether the medium P has been conveyed to a point where the leading edge portion of the medium P reaches the fixation device 103. If the print controller 12 determines that the leading edge portion of the medium P has reached the fixation device 103, the processing proceeds back to S104. If the print controller 12 determines that the leading edge portion of the medium P has not reached yet, the printer controller 12 continues the conveyance of the medium P until the leading edge portion of the medium P reaches the fixation device 103. Although the determination on whether the leading edge portion of the medium P has reached at the fixation device 103 is made based on the amount of rotation of the belt motor 14, it may be made based on a medium detection sensor disposed at the fixation device 103.

S104: Once the leading edge portion of the medium P reaches the fixation device 103, the fixing speed controller 15 starts fixing speed control in the coarse speed control period Ca illustrated in FIG. 4 (coarse speed control).

S105: The fixing speed controller 15 receives ON/OFF information on the deflection sensor 104 from the deflection detector 17 and determines whether the deflection sensor 104 has detected deflection of the medium P. The processing proceeds to S107 if it is determined that deflected condition has been detected, and proceeds to S106 otherwise.

S106: If determining that the deflection sensor 104 has detected no deflection of the medium P, i.e., that the deflection sensor 104 has detected that the medium P is stretched, the fixing speed controller 15 decreases the fixing speed of the fixing motor 16, and the processing proceeds to S108. In this process, the fixing speed controller 15 decreases the fixing speed by a decrease amount of the upper-limit subtraction value ΔVd/M illustrated in FIG. 5.

S107: If determining that the deflection sensor 104 has detected deflection of the medium P, the fixing speed controller 15 increases the fixing speed of the fixing motor 16, and the processing proceeds to S108. In this process, the fixing speed controller 15 increases the fixing speed by an increase amount of the upper-limit addition value ΔVa/N illustrated in FIG. 5.

S108: For calculation of an average fixing speed, the fixing speed controller 15 notifies the average speed calculator 18 of fixing speed information and medium conveying distance information every time a control interval elapses. The average speed calculator 18 cumulatively adds the fixing speed indicated by the notified fixing speed information to the cumulative fixing speed value stored in the storage device, and stores the new cumulative fixing speed value in the storage device. The average speed calculator 18 also cumulatively adds the medium conveying distance indicated by the notified medium conveying distance information to the cumulative medium conveying distance value stored in the storage device, and stores the new cumulative medium conveying distance value in the storage device. The average speed calculator 18 further stores the number of times the fixing speed information and the medium conveying distance information have been notified of in the storage device as a control count.

S109: The print controller 12 determines whether all the print data instructed by the print command have been printed. The processing proceeds to S110 if it is determined that the printing is not finished, and proceeds to S114 otherwise.

S110: After the print controller 12 determines that the printing is not finished, the average speed calculator 18 determines whether the cumulative medium conveying distance value (i.e., the conveying distance of the medium P) stored in the storage device is equal to or above the predetermined distance X. The processing proceeds to S111 if the conveying distance of the medium P is equal to or above the predetermined distance X, and proceeds back to S105 otherwise.

S111: If determining that the conveying distance of the medium P is equal to or above the predetermined distance X, the average speed calculator 18 calculates an average fixing speed by dividing the cumulative fixing speed value by the control count. The average speed calculator 18 then generates an average speed application command for causing the calculated average fixing speed to be applied to the fixing speed, and notifies the fixing speed controller 15 of the average speed application command. In this way, the average speed calculator 18 calculates an average fixing speed in the coarse speed control period Ca (a first average fixing speed) and an average fixing speed in the fine speed control period Cb (a second average fixing speed) illustrated in FIG. 4 every time the coarse speed control period Ca and the fine speed control period Cb elapses.

S112: The fixing speed controller 15 applies the average fixing speed instructed by the average speed application command to the fixing speed. As illustrated in FIG. 4, the fixing speed controller 15 sequentially updates the fixing speed Vf0' by applying the average fixing speed in the coarse speed control period Ca to the fixing speed Vf0' for the next fine speed control period Cb, and applying the average fixing speed in the fine speed control period Cb to the fixing speed Vf0' for the next fine speed control period Cb.

S113: After applying the average fixing speed instructed by the average speed application command to the fixing speed, the fixing speed controller 15 starts the fixing speed control in the fine speed control period Cb illustrated in FIG. 4 (fine speed control), and the processing proceeds to S105. In this process, the fixing speed controller 15 sets, for the fine speed control period Cb illustrated in FIG. 4, the upper-limit addition value ΔVa', the upper-limit subtraction value ΔVd', a speed increase amount, and a speed decrease amount for the fixing speed Vf.

S114: On the other hand, if determining in S109 that the printing is finished, the print controller 12 initializes the cumulative fixing speed value, the cumulative medium conveying distance value, and the control count, which are stored in the storage device by the average speed calculator 18, to "0", and the processing ends.

As described, in a first embodiment, the period to perform fixing speed control in order to keep deflected condition of a medium by increasing and decreasing the fixing speed based on an output from the deflection sensor is divided into the coarse speed control period from when the leading edge portion of a medium reaches the fixation device to when the medium is conveyed a predetermined distance and the fine speed control period, which starts after the coarse speed control period ends. In the coarse speed control period, the fixing speed is controlled such that the fixing speed is changed by a large amount to be able to absorb variation in the fixing speed, and in the fine speed control period, the fixing speed is controlled by application of the average fixing speed calculated in the coarse speed control period to the fixing speed.

The fixing speed in the coarse speed control period is a speed at which a medium can maintain a predetermined amount of deflection through change of the fixing speed, and the average fixing speed converges near the belt speed. Thus, when the average fixing speed calculated in the coarse speed control period is applied to the fixing speed for the fine speed control period, the amount of variation in the fixing speed can be reduced, which enables a medium to be conveyed with the behavior (vertical movement) of the medium stabilized.

Further, the coarse speed control period, in which the fixing speed varies widely, can be shortened as much as possible, and the behavior of a medium can be stabilized in the fine speed control period, in which the average fixing speed in the coarse speed control period is applied to the fixing speed.

Furthermore, since the fixing speed control is performed throughout the conveyance of a medium, when the medium conveyed is long, growth of deflection of the medium is prevented and becomes stretched between the belt unit and the fixation device before the tailing edge of the medium reaches the deflection area. Thus, degradation in print quality is suppressed.

As described thus far, a first embodiment changes the fixing speed by calculating an average fixing speed in the coarse speed control period, which is a predetermined period in which the fixing speed widely varies, and applying the average fixing speed to the fixing speed for the fine speed control period which starts after the coarse speed control period. The embodiment thus produces the following advantageous effects. Specifically, the embodiment is able to convey a medium with the behavior of the medium stabilized through change of the fixing speed, and thus suppresses degradation in image quality.

In addition, the coarse speed control period with wide variation in the fixing speed can be shortened as much as possible, and therefore, stable medium conveyance can be achieved.

Furthermore, the embodiment prevents a long medium from becoming stretched, thus reducing degradation in print quality. As described above, the present disclosure is advantageously capable of stable medium conveyance and therefore of less degradation in image quality.

Second Embodiment

The configuration of a second embodiment is such that the printer control configuration in a first embodiment additionally includes an average speed applier.

Figure 7:
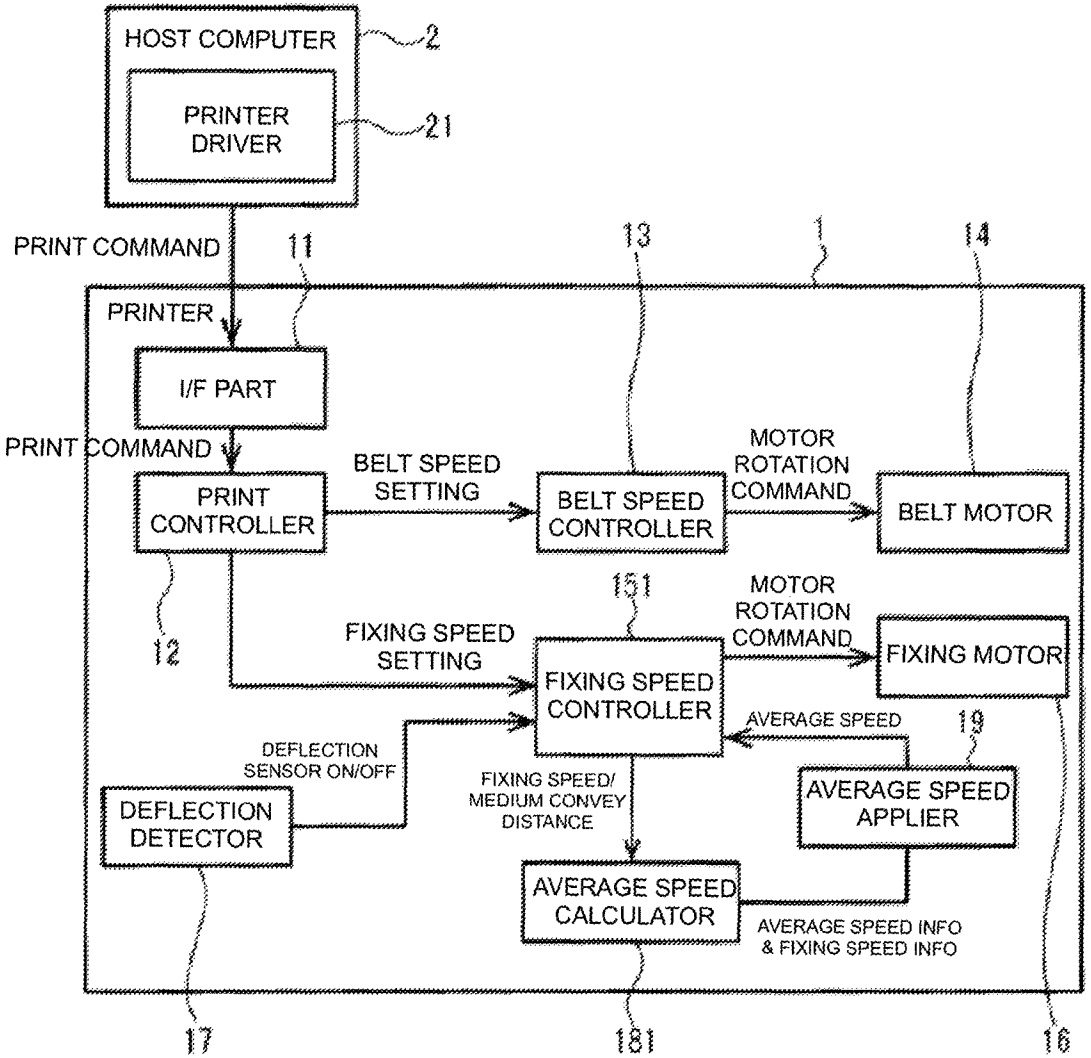
FIG. 7 is a block diagram illustrating a control configuration of a printer according to a second embodiment.

FIG. 7 is a block diagram illustrating the control configuration of a printer according to a second embodiment. Note that the configuration of the printer is the same as that of a first embodiment illustrated in FIGS. 2, 3A, 3B, and 3C, and is therefore not described below. In addition, parts that are the same as those in a first embodiment are denoted by the same reference numerals used in in a first embodiment, and are not described below.

In FIG. 7, the printer 1 has the I/F part 11, the print controller 12, the belt speed controller 13, the belt motor 14, a fixing speed controller 151, the fixing motor 16, the deflection detector 17, an average speed calculator 181, and an average speed applier 19.

The print controller 12 acquires a print command received from the host computer 2 through the I/F part 11, and controls the controllers based on the print command to form and print an image on a medium. The print controller 12 notifies the belt speed controller 13 of belt speed setting information to set the convey speed of the belt, and notifies the fixing speed controller 151 of fixing speed setting information to set a criteria fixing speed.

Based on the fixing speed setting (criteria fixing speed as a basis) information notified of by the print controller 12, the fixing speed controller 151 outputs a motor rotation command to the fixing motor 16 to start rotating the fixing motor 16, and then controls, i.e., increases or decreases, the rotation speed of the fixing motor 16 based on ON/OFF information on the deflection sensor 104 from the deflection detector 17 to control the rotation speed of the fixing rollers of the fixation device.

Also, the fixing speed controller 151 notifies the average speed calculator 181 of fixing speed information and medium conveying distance information at a predetermined interval of time for controlling the rotation speed of the fixing motor 16.

Further, based on a command (namely an average speed application command) from the average speed applier 19, the fixing speed controller 151 controls the rotation of the fixing motor 16 by outputting a motor rotation command to the fixing motor 16 based on the average speed of the fixing motor 16 calculated by the average speed calculator 181, and thereby changes the criteria fixing speed, which is the rotation speed of the fixing rollers of the fixation device.

The fixing motor 16 rotates based on a motor rotation command outputted from the fixing speed controller 151 and thereby rotates the fixing rollers (103*a*, 103*b*) of the fixation device 103 illustrated in FIGS. 3A, 3B, and 3C to convey a medium.

The deflection detector 17 notifies the fixing speed controller 151 of ON/OFF information which is information on an output signal from the deflection sensor 104 illustrated in FIGS. 3A, 3B, and 3C. The deflection detector 17 detects (monitors), using the deflection sensor 104, deflection of a medium conveyed from the belt unit 101 illustrated in FIGS. 3A, 3B, and 3C to the fixation device 103 through the deflection area E, and notifies the fixing speed controller 151 of ON/OFF information indicative of the detected state.

The fixing speed controller 151 makes a speed adjustment by generating a new motor rotation command by adding speed change information based on the ON/OFF information notified of and outputting the new motor rotation command to the fixing motor 16 to change the speed of the fixing motor 16.

The average speed calculator 181 calculates an average fixing speed within a predetermined conveying distance of a medium P based on fixing speed information and medium conveying distance information notified of by the fixing speed controller 151, generates average speed information, and notifies the average speed applier 19 of the average speed information along with the fixing speed information notified of. The average speed information indicates an average fixing speed calculated by the average speed calculator 181.

Based on the fixing speed information and the average speed information notified of by the average speed calculator 181, the average speed applier 19 determines whether the average speed indicated by the average speed information is applicable to the fixing motor 16. When it is possible to apply, the average speed applier 19 notifies the fixing speed controller 151 of an average speed application command instructing to apply the average speed indicated by the average speed information to a motor rotation command to the fixing motor 16.

Notified of the average speed application command by the average speed applier 19, the fixing speed controller 151 controls the criteria fixing speed regarding the rotation speed of the fixing rollers of the fixation device based on the average speed application command, and also, switches information on change in the speed of the fixing motor from a speed change value for coarse speed control to a speed change value for fine speed control.

The printer 1 thus constituted includes a controller such as a CPU and a storage part such as memory, and the controller controls the overall operation of the printer 1 based on a control program (software) stored in the storage part. Further, the printer 1 performs fixing speed control in which the fixing speed controller 151 adjusts the speed of the fixing motor 16 so that the amount of deflection of the medium P generated in the deflection area E illustrated in FIGS. 3A, 3B, and 3C may stay within a predetermined range.

Figure 8:
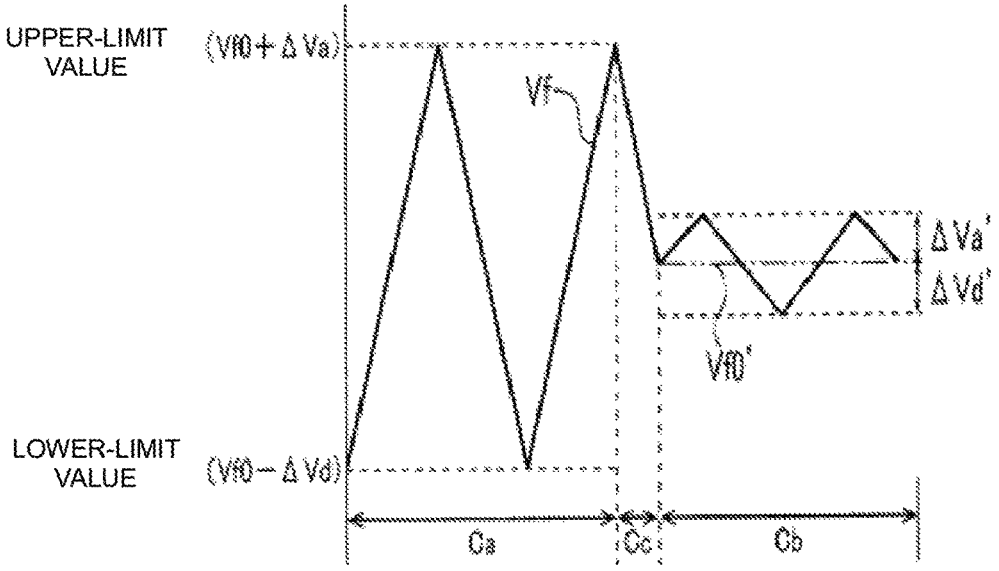
FIG. 8 is a timing chart illustrating fixing speed control according to a second embodiment.

FIG. 8 is a timing chart illustrating fixing speed control according to a second embodiment.

With reference to FIG. 8 and also to FIG. 7, the fixing speed control performed by the printer is described. Note that FIG. 8 illustrates a period where the coarse speed control period Ca is switched to the fine speed control period Cb illustrated in FIG. 4.

In FIG. 8, a second embodiment has a speed switch period Cc between the coarse speed control period Ca and the fine speed control period Cb.

In the coarse speed control period Ca, fixing speed control similar to that performed in the coarse speed control period Ca illustrated in FIG. 4 is performed. In the fine speed control period Cb, fixing speed control similar to that performed in the fine speed control period Cb illustrated in FIG. 4 is performed. When the fixing speed at the end of the coarse speed control period Ca is outside the fine speed control range, the speed switch period Cc is provided, in which the fixing speed controller 151, the average speed calculator 181, and the average speed applier 19 change the fixing speed.

In the speed switch period Cc, an amount by which to change the fixing speed in the coarse speed control period Ca (e.g., the fixing speed change amount illustrated in FIG. 5) is used to change the fixing speed, and the fixing speed is changed each time until the fixing speed reaches the fixing speed Vf0'.

The amount by which to change the fixing speed in the coarse speed control period Ca continues to be used in the speed switch period Cc. Thereby, a drastic change or an excessively gentle change in the fixing speed is reduced, making it possible to maintain an appropriate amount of deflection generated in a medium.

Once the fixing speed reaches the fixing speed Vf0' and enters the fine speed control range, the speed switch period Cc ends, and the fine speed control period Cb starts to perform the fine speed control using the fixing speed similar to that used in the fine speed control period Cb illustrated in FIG. 4.

Thus performing the fixing speed control enables the amount of deflection generated in a medium to be always maintained at an appropriate amount.

Although the fixing speed is changed in the same amount in the speed switch period Cc and in the coarse speed control period Ca in a second embodiment, the present disclosure is not limited to the above case. The fixing speed may be changed in different amounts in the speed switch period Cc and in the coarse speed control period Ca as long as the amount of deflection generated in a medium can be maintained at an appropriate amount.

As described, the fixing speed controller 151 of the printer 1 continues to perform the fixing speed control for the coarse speed control period Ca even after the coarse speed control period Ca elapses, and once the fixing speed enters the fine speed control range for the fine speed control period Cb, starts fine speed control using the average fixing speed for the coarse speed control period Ca as a criteria fixing speed for the fine speed control period Cb.

The operation of the above-described configuration is described.

Figure 9:
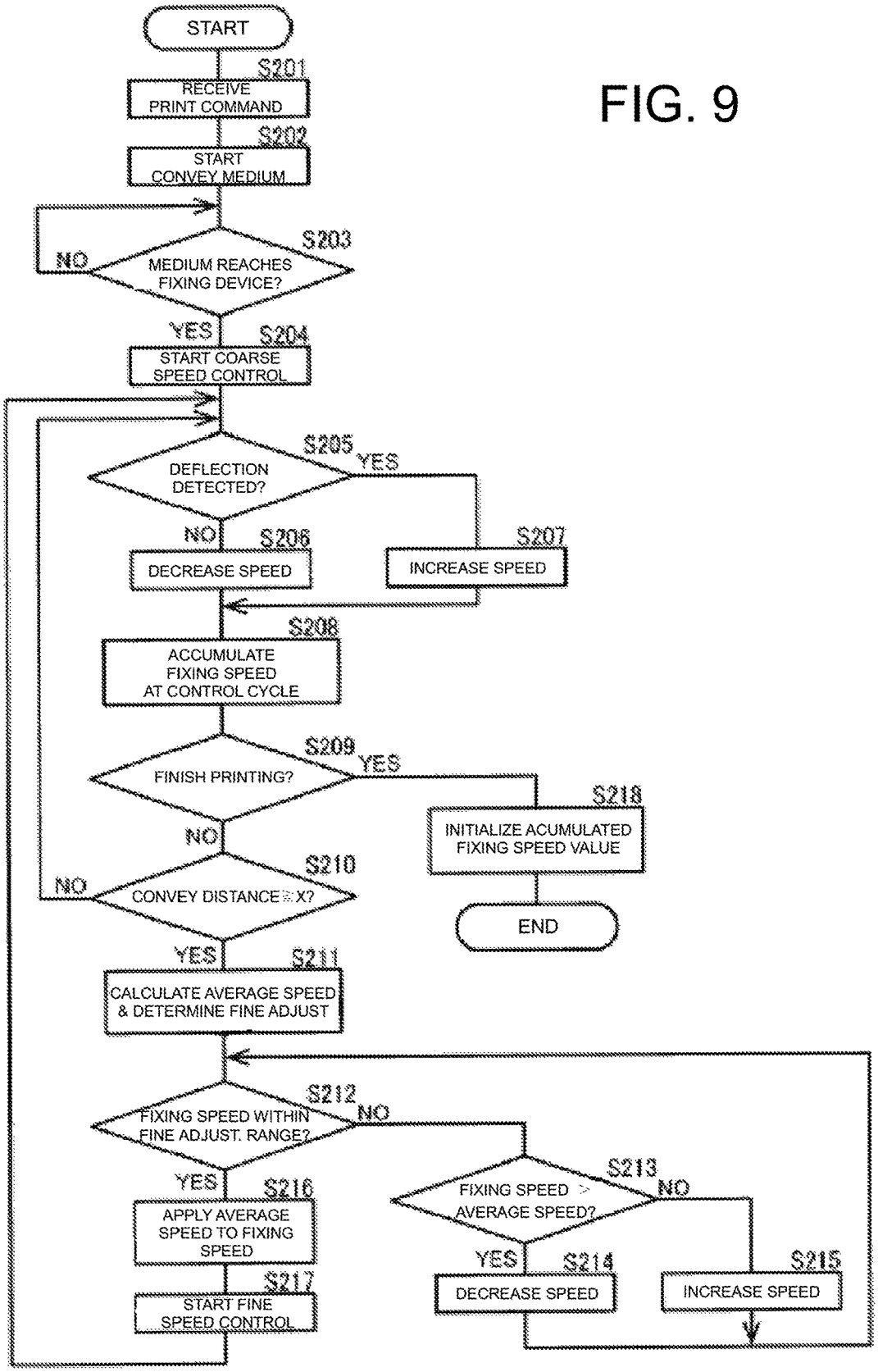
FIG. 9 is a flowchart illustrating fixing speed control processing according to a second embodiment.

FIG. 9 illustrates a flowchart of fixing speed control processing performed by the printer. Following the steps denoted by S in the flowchart in FIG. 9, fixing speed control processing according to a second embodiment is described with additional reference to FIGS. 3A to 3C, 7, and 8.

S201 to S209: These steps are the same as S101 to S109 in FIG. 6, and are therefore not described here.

S210: If the print controller 12 determines that the printing is not finished, the average speed calculator 181 determines whether the cumulative medium conveying distance value (i.e., the conveying distance of the medium P) stored in the storage device is equal to or above the predetermined distance X. The processing proceeds to S211 if the conveying distance of the medium P is equal to or above the predetermined distance X, and proceeds back to S205 otherwise.

S211: If determining that the conveying distance of the medium P is equal to or above the predetermined distance X, the average speed calculator 181 calculates an average fixing speed by dividing the cumulative fixing speed value by the control count. The average speed calculator 181 then generates average speed information indicative of the average fixing speed calculated, and notifies the average speed applier 19 of the average speed information along with the fixing speed information notified of by the fixing speed controller 151.

The average speed applier 19 determines a fine adjustment speed range based on the average fixing speed indicated by the average speed information notified of by the average speed calculator 181. For example, this fine adjustment speed range is from (the average fixing speed−the upper-limit subtraction value ΔVd') to (the average fixing speed)+(the upper-limit addition value ΔVa').

S212: Based on the fixing speed information notified of by the average speed calculator 181, the average speed applier 19 determines whether the fixing speed is within the fine adjustment speed range. The processing proceeds to S216 if it is determined that the fixing speed is within the fine adjustment speed range, and proceeds to S213 otherwise.

S213: If determining that the fixing speed is not within the fine adjustment speed range, the average speed applier 19 compares, at the control interval, the fixing speed indicated by the fixing speed information notified of by the average speed calculator 181 with the average speed (average fixing speed) which has already been notified of by the average speed calculator 181. The processing proceeds to S214 if it is determined that the fixing speed is higher than the average speed, and proceeds to S215 otherwise.

Note that it is assumed here that the average speed calculator 181 notifies the average speed applier 19 of the fixing speed information notified of by the fixing speed controller 151, at the control interval.

S214: After the average speed applier 19 determines that the fixing speed is higher than the average speed, the fixing speed controller 151 increases the fixing speed of the fixing motor 16, and the processing proceeds back to S212. In this process, the fixing speed controller 151 increases the fixing speed by a speed increase amount of the upper-limit addition value ΔVa/N which is also used for the coarse speed control period Ca illustrated in FIG. 5.

S215: After the average speed applier 19 determines that the fixing speed is equal to or lower than the average speed, the fixing speed controller 151 decreases the fixing speed of the fixing motor 16, and the processing proceeds back to S212. In this process, the fixing speed controller 151 decreases the fixing speed by a speed decrease amount of the upper-limit subtraction value ΔVd/M which is also used for the coarse speed control period Ca illustrated in FIG. 5.

S216: After determining in S212 that the fixing speed is within the fine adjustment speed range, the average speed applier 19 generates an average speed application command for applying the average fixing speed calculated by the average speed calculator 181 in S211 to the fixing speed, and notifies the fixing speed controller 15 of the average speed application command. The fixing speed controller 15 applies the average fixing speed instructed by the average speed application command to the fixing speed.

S217: After applying the average fixing speed instructed by the average speed application command to the fixing speed, the fixing speed controller 15 starts fixing speed control in the fine speed control period Cb illustrated in FIG. 4 (i.e., the fine speed control), and the processing proceeds to S205. In this process, the fixing speed controller 151 sets, for the fine speed control period Cb illustrated in FIG. 4, the upper-limit addition value ΔVa', the upper-limit subtraction value ΔVd', a speed increase amount, and a speed decrease amount for the fixing speed Vf.

S218: On the other hand, if determining in S209 that the printing is finished, the print controller 12 initializes the cumulative fixing speed value, the cumulative medium conveying distance value, and the control count, which are stored in the storage device by the average speed calculator 181, to "0", and the processing ends.

As described, in a second embodiment, in the speed switch period Cc which is a period of transition from the coarse speed control period Ca to the fine speed control period Cb, the amount by which to change the fixing speed used in the coarse speed control period Ca continues to be used, which reduces a steep or excessively gentle change at the switch from the coarse speed control period Ca to the fine speed control period Cb, so that the amount of deflection generated in a medium can be maintained at an appropriate amount.

Figure 10A:
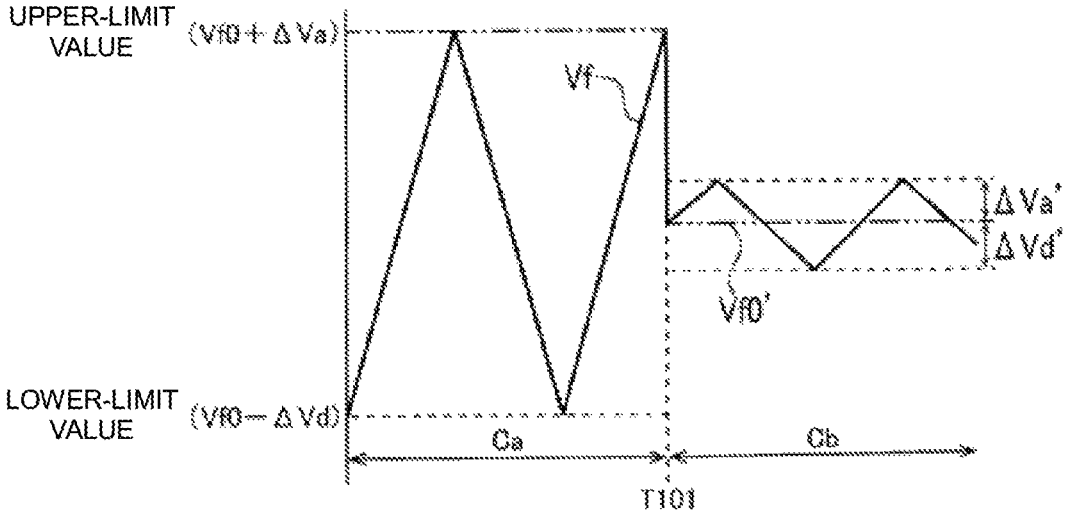
FIGS. 10A and 10B are diagrams illustrating fixing speed control according to a comparison example.

The steep change in the fixing speed caused by the switch from the coarse speed control period Ca to the fine speed control period Cb means that, as illustrated in FIG. 10A for example, when the fixing speed Vf is at the upper-limit fixing speed (Vf0+ΔVa) at the end of the coarse speed control period Ca, there is substantially zero time T101 for the fixing speed Vf to change to the fixing speed Vf0', which is the average fixing speed in the coarse speed control period Ca, so that the fixing speed Vf suddenly changes in a short time (instantaneously).

If the fixing speed Vf becomes drastically slower than the belt speed due to the drastic change in the fixing speed Vf, an excessive deflection is generated in a medium, and toner images yet to be fixed touch a member inside the printer, which degrades image quality. If the fixing speed becomes drastically faster than the belt speed due to the drastic change in the fixing speed Vf, the medium becomes excessively stretched, which may affect driving of the transfer belt, producing a "shock line" (a white line) in the toner images.

Figure 10B:
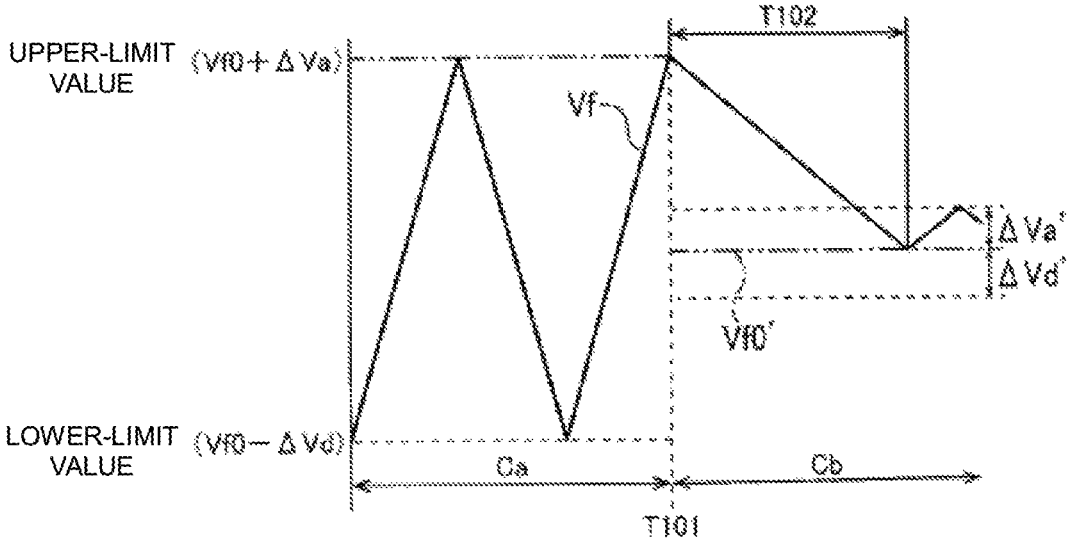

In addition, the excessively gentle change in the fixing speed caused by the switch from the coarse speed control period Ca to the fine speed control period Cb means that, as illustrated in FIG. 10B for example, if the fixing speed Vf is changed in an amount used for the fine speed control period Cb at the end of the coarse speed control period Ca, it takes a long time T102 for the fixing speed V at the upper-limit fixing speed (Vf0+αVa) at the end of the coarse speed control period Ca to change to the fixing speed Vf0', which is the average fixing speed in the coarse speed control period Ca, making the change from the fixing speed Vf to the fixing speed Vf0' very gentle.

If the fixing speed Vf thus changes gently, the time in which the fixing speed is faster or slower than the belt speed increases, which may cause a medium to be stretched or deflected excessively.

In a second embodiment, even if the fixing speed has to be changed by a large amount at the end of the coarse speed control period Ca to reach the average fixing speed in the coarse speed control period Ca, an amount by which to change the fixing speed for the coarse speed control period Ca continues to be used, which reduces a steep or excessively gentle change in the fixing speed, so that an amount of deflection generated in a medium can be maintained at an appropriate amount.

A second embodiment has the speed switch period Cc between the coarse speed control period Ca and the fine speed control period Cb, and an amount by which to change the fixing speed used in the coarse speed control period Ca continues to be used in the speed switch period Cc. Thus, in addition to the advantageous effects produced by a first embodiment, a second embodiment helps prevent the fixing speed from changing steeply or too gently in the shift from the coarse speed control period Ca to the fine speed control period Cb, and hence enables an amount of deflection generated in a medium to be maintained at an appropriate amount.

Although the image formation apparatus is described as a printer, the image formation apparatus may be other devices such as a facsimile machine or a multi-functional peripheral (MFP).

The disclosure includes other embodiments in addition to the above-described embodiments without departing from the spirit of the disclosure. The embodiments are to be considered in all respects as illustrative, and not restrictive. The scope of the disclosure is indicated by the appended claims rather than by the foregoing description. Hence, all configurations including the meaning and range within equivalent arrangements of the claims are intended to be embraced in the description.

The invention claimed is:

1. An image formation apparatus comprising:

a first conveyer that conveys a medium in a predetermined speed;

a second conveyer that is disposed downstream of the first conveyer in a conveying direction of the medium, and is configured to convey the medium at a variable conveyance speed;

a detector that detects a deflection of the medium between the first and second conveyers;

a speed controller that controls a speed of the second conveyer within a first speed range based on a detection result from the detector; and a calculator that calculates a first speed of the second conveyer in a first period in which the medium is conveyed a predetermined distance from the second conveyer, after a leading end of the medium reaches the second conveyer, wherein the speed controller changes, in a second period after the first period elapses, the speed of the second conveyer within a second speed range with the calculated first speed as a criteria speed of the second conveyer for the second period, based on the detection result from the detector.

2. The image formation apparatus according to claim 1, wherein the second speed range is narrower than the first speed range.

3. The image formation apparatus according to claim 1, wherein the calculator calculates a second speed of the second conveyer in the second period in which the medium is conveyed the predetermined distance after the first period elapses, at each time when the second period elapses, and the speed controller sets the calculated second speed as a criteria speed of the second conveyer for a next second period at each time when the second period elapses.

4. The image formation apparatus according to claim 3, wherein the speed controller executes a first convey speed control that increases or decreases the speed of the second conveyer by a first change amount at predetermined control intervals in the first period, and executes a second convey speed control that increases or decreases the speed of the second conveyer by a second change amount at the predetermined control intervals in the second period, wherein the second change amount is smaller than the first change amount.

5. The image formation apparatus according to claim 4, wherein the speed controller continues the first convey speed control until the speed of the second conveyer enters in the second speed range after the first period elapses, and starts, after the speed of the second conveyer enters in the second speed range, the second convey speed control with setting the calculated first speed as the criteria speed of the second conveyer for the second period.

6. The image formation apparatus according to claim 3, wherein the calculated second speed of the second conveyer in the second period is an average convey speed of the second conveyer in the second period.

7. The image formation apparatus according to claim 1, wherein the first conveyer includes a belt unit that transfers a developer image to the medium.

8. The image formation apparatus according to claim 1, wherein the second conveyer comprises a fixation device that fuses a developer image on the medium and thus fixes the developer image onto the medium.

9. The image formation apparatus according to claim 1, wherein each of the first conveyer and the second conveyer includes a roller that is in contact with and coveys the medium.

10. The image formation apparatus according to claim 9, wherein the diameter of the roller in the second conveyer is larger than the diameter of the roller in the first conveyer.

11. The image formation apparatus according to claim 9, wherein the roller of the second conveyer includes a heating member therein to fuse a developer image on the medium thereby to fix the developer image onto the medium.

12. The image formation apparatus according to claim 1, wherein the detector is disposed below a conveyance path of the medium between the first and second conveyers.

13. The image formation apparatus according to claim 1, wherein the calculated first speed of the second conveyer in the first period is an average convey speed of the second conveyer in the first period.

14. An image formation apparatus comprising:

a first conveyer that conveys a medium in a predetermined speed;

a second conveyer that is disposed downstream of the first conveyer in a convey direction of the medium, and is configured to convey the medium at a variable conveyance speed;

a detector that detects a deflection of the medium generated between the first and the second conveyers;

a speed controller that controls a speed of the second conveyer based on a detection result from the detector; and a calculator that calculates a first speed of the second conveyer in a first period in which the medium is conveyed a predetermined distance from the second conveyer after a leading end of the medium reaches the second conveyer, wherein the speed controller executes:

a first convey speed control, in the first period, that changes the speed of the second conveyer within a first speed range;

a transition control that continues the first convey speed control until the speed of the second conveyer enters in a second speed range with respect to the calculated first speed after the first period elapses, wherein the second speed range is narrower than the first speed range; and a second convey speed control, in a second period in which the medium is conveyed the predetermined distance after the transition control, that controls the speed of the second conveyer within the second speed range with the calculated first speed as a criteria speed of the second conveyer for the second period, based on the detection result from the detector.

15. An image formation apparatus comprising:

a first conveyer that conveys a medium in a predetermined speed;

a second conveyer that is disposed downstream of the first conveyer in a conveying direction of the medium, and is configured to convey the medium at a variable conveyance speed;

a detector that detects a deflection of the medium between the first and second conveyers; and a speed controller that controls, based on a detection result from the detector, a speed of the second conveyer, wherein the speed controller:

in a first period in which the medium is conveyed a predetermined distance from the second conveyer after a leading end of the medium reaches the second conveyer, controls the speed of the second conveyer within a first speed range with respect to a first criteria speed; and in a second period after the first period elapses, controls the speed of the second conveyer within a second speed range narrower than the first speed range with respect to a second criteria speed determined based on a speed of the second conveyer in the first period.

* * * * *